US005421032A

United States Patent [19]

Murphy

[11] Patent Number: 5,421,032

[45] Date of Patent: Jun. 6, 1995

[54] BATHING SUIT WITH TETHERED WATERPROOF POUCH

[76] Inventor: Edward D. Murphy, 1550 Avenida Salvador, San Clemente, Calif. 92672

[21] Appl. No.: 263,546

[22] Filed: Jun. 22, 1994

[51] Int. Cl.[6] ..... A41D 5/00

[52] U.S. Cl. ..... 2/67; 2/228; 2/247

[58] Field of Search ..... 2/67, 238, 227, 228, 2/247, 249, 251, 253, 271, 94, 108; 224/240, 251, 235, 236; 150/38, 42, 45, 28, 37, 34, 52, 43, 35, 134

[56] References Cited

U.S. PATENT DOCUMENTS

| | | | |
|---|---|---|---|
| 2,908,306 | 10/1959 | Chorost | 150/134 |
| 3,193,842 | 7/1965 | Bell | 2/94 |
| 4,145,762 | 3/1979 | Wallach | 2/67 |
| 4,194,655 | 3/1980 | Tillotson | 224/191 |
| 4,416,315 | 11/1983 | Foley | 150/134 |

*Primary Examiner*—Clifford D. Crowder

*Assistant Examiner*—Gloria Hale

*Attorney, Agent, or Firm*—Calif Kip Tervo

[57] ABSTRACT

A bathing suit includes a pocket, a waterproof pouch disposed in the pocket and a tether having a first end attached to the suit and a second end attached to the waterproof pouch. The tether is flexible and of sufficient length such that the waterproof pouch can be removed from the pocket for inserting therein items for safekeeping. The pouch is made of pliable waterproof material and has a sealable opening such that, when sealed, liquids may not enter. Preferred embodiment, the pocket is constructed such that the tether can be anchored to the suite's waistband. Preferably, also, the pocket is constructed such that the tether is concealed entirely within the pocket during storage of the pouch. With use of a rear pocket, the tether is sufficiently long such that the pouch can be removed from the rear pocket and held to the front of a wearer for inserting therein items for safekeeping.

8 Claims, 1 Drawing Sheet

BATHING SUIT WITH TETHERED WATERPROOF POUCH

BACKGROUND OF THE INVENTION

1. Field of the Invention

This invention relates in general to swim wear having storage pockets and more particularly to a swimsuit having a waterproof pouch tethered to a pocket.

2. Background of the Invention

Persons participating in water sports often encounter the problem of what to do with water-damageable valuables, such as paper money or wallet, while the person is in or near the water. There is a particularly high incidence of theft of such items left on the beach while the owner is in the water.

There are several designs for waterproof containers into which valuables can be placed and then inserted in a swimsuit pocket. This method has a several major drawbacks. Many water sports are very active such that items stored in a pocket tend to dislodge. Even pockets that have a closure, such as a fastener or flap, often open and dump their contents. Also, waterproof containers generally float and continually try to float upwards out of a pocket.

Therefore, there has been a need for an improved method of keeping water-damageable valuables on the person while engaging in water sports.

SUMMARY OF THE INVENTION

According to an embodiment of the invention, a bathing suit includes a pocket, a waterproof pouch disposed in the pocket and a tether having a first end attached to the suit and a second end attached to the waterproof pouch. The tether is flexible and of sufficient length such that the waterproof pouch can be removed from the pocket for inserting therein items for safekeeping. The pouch is made of pliable waterproof material and has a sealable opening such that, when sealed, liquids may not enter.

In a preferred embodiment, the pocket is constructed such that the tether can be anchored to the suit's waistband.

In a preferred embodiment, the pocket is constructed such that the tether is concealed entirely within the pocket during storage of the pouch.

In another embodiment, the pouch is in a rear pocket and the tether is sufficiently long such that the pouch can be removed from the rear pocket and held to the front of a wearer for inserting therein items for safekeeping.

Other features and many attendant advantages of the invention will become more apparent upon a reading of the following detailed description together with the drawings in which like reference numerals refer to like parts throughout.

DETAILED DESCRIPTION OF THE INVENTION

Figure 1:
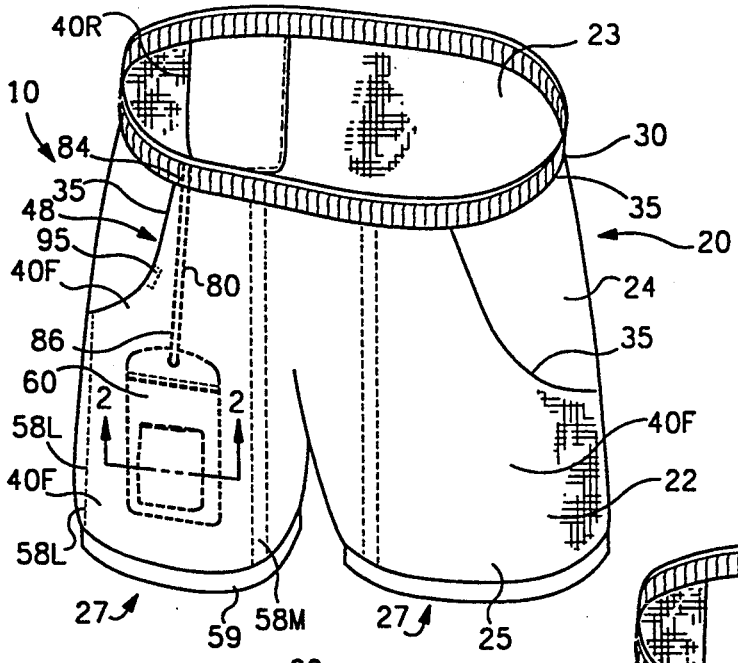
FIG. 1 is a front perspective view of the invention showing a swimsuit and showing, in phantom, the suit front pocket with tethered waterproof pouch and tether therein.

With reference now to the drawings, and more particularly to FIG. 1 thereof, there is shown a front perspective view of the invention, denoted generally as 10, showing a suit, such as swimsuit 20, and showing, in phantom, the suit front pocket 40 with tethered waterproof pouch 60 and tether 80 therein.

Suit 20, shown, is intended to be representative of most any swimsuit and generally includes material 22 circumscribing the body of a wearer and includes a front 25 and a rear 26, leg openings 27 and a waist portion 30. Suit 20 has an inner side 23 toward a wearer and an outer side 24.

Waist portion 30 typically is a reinforced area including several horizontal seams which entrap an elastic band and may contain a draw string tie for adjustment to the waist of the wearer. The suit may include a internal liner, typically brief-shaped of lighter material than material 22 and typically attached to waist portion 30.

Slits 35 in suit 20 lead to pockets 40, including front pockets 40F and rear pocket 40R. Pockets 40 are disposed on the inner side 23 of suit 20 and connected to suit 20.

Figure 2:
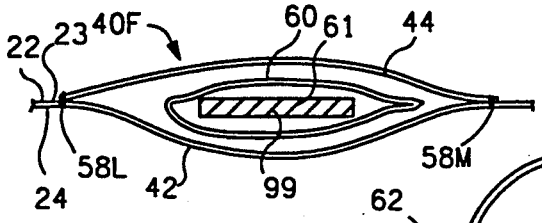
FIG. 2 is a sectional view taken on line 2—2 of FIG. 1.

Looking additionally at FIG. 2 there is shown a sectional view taken on line 2—2 of FIG. 1. In the preferred embodiment, shown, front pocket 40F uses suit material 22 as its front wall 42. Pocket rear wall 44 is attached to suit 20 along the sides at seams 58, including medial seam 58M and lateral seam 58L, along the bottom at hem 59, and along the top at waist 30. Bottom seam 59 need not be at the hem but may be above the hem seam. The top portion of pocket 40F includes an opening 48 arranged in registration with slit 35 in suit 20 to form an ingress and egress to pocket 40F.

Many other configurations of pocket 40 are possible but the preferred embodiments shown offer several advantages. Other configurations include the standard complete bag-like pocket having an opening attached around slit 35 and not utilizing any of the suit material in its construction.

A waterproof pouch 60 is disposed in pocket 40F. Pouch 60 is typically constructed of vinyl or other waterproof material 61 and includes an opening 62 having a waterproof seal 64. The preferred seal 64 is an waterproof interlocking lip arrangement. Seal 64 may be such as is incorporated on some types of ZIPLOC® bags or on OMNISEAL (tm) bags whereby a seal is formed from squeezing the two sides of the opening together. When pouch 60 is sealed, liquids may not enter. Preferably, pouch 60 is large enough to hold a wallet 99, but may be small and hold only a few bills or identification.

Pouch 60 is made of pliable waterproof material 61 and is capable of passing through the pocket opening and slit 35.

Pouch 60 includes a tab 66 including means, such as grommet 67, for attachment of tether 80.

Preferably, tether 80 has a first end 84 attached to suit 20. First end 84 is preferably attached to waist 30 such as by sewing it into the waist seam 31. Waist seam 31 is the most secure anchor point for tether 80 and the configuration shown allows fixation to waistband 30 while still concealing tether 80 entirely within pocket 40F during storage of pouch 60 therein. Alternately, first end 84 can be attached to pocket 40 or other suitable location. Tether second end 86 is attached to pouch 60. In the preferred embodiment, tether second end 86 is attached to the grommet 67 of pouch tab 66.

Figure 3:
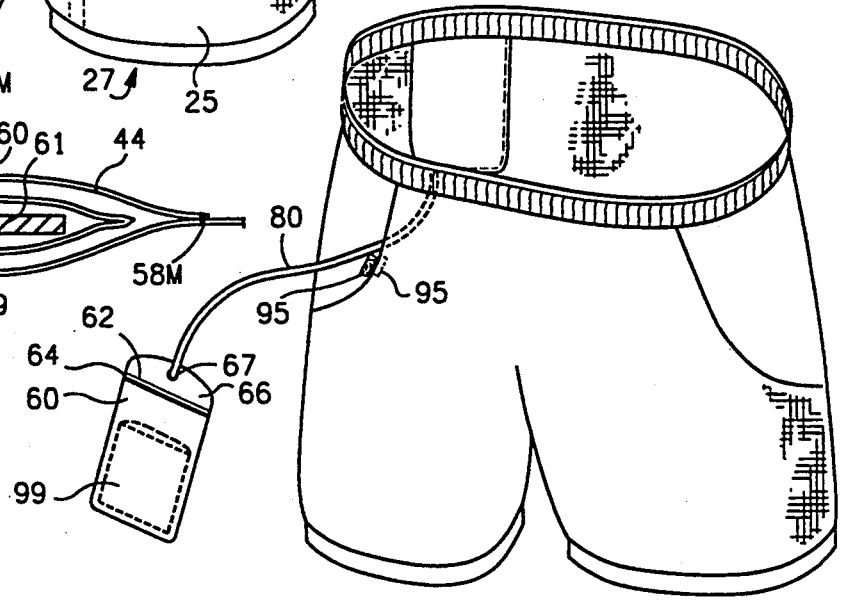
FIG. 3 is a perspective view of the suit of FIG. 1 showing the waterproof pouch removed from the suit front pocket.

FIG. 3 is a perspective view of the suit 20 of FIG. 1 showing the waterproof pouch removed from the suit front pocket. Tether 80 is a flexible cord of sufficient length such that pouch 60 can be removed from pocket 40F for inserting therein items, such as wallet 99, for safekeeping.

Pocket opening 48 includes closure means, such as mating hook/loop fasteners 95 on front wall 42 and rear wall 44 to aid in retaining pouch 60 in pocket 40. Other direct closure means are contemplated, such as buttons, or indirect means, such as a flap over slit 35 secured by any suitable means, such as hook/loop fastener material.

Figure 4:
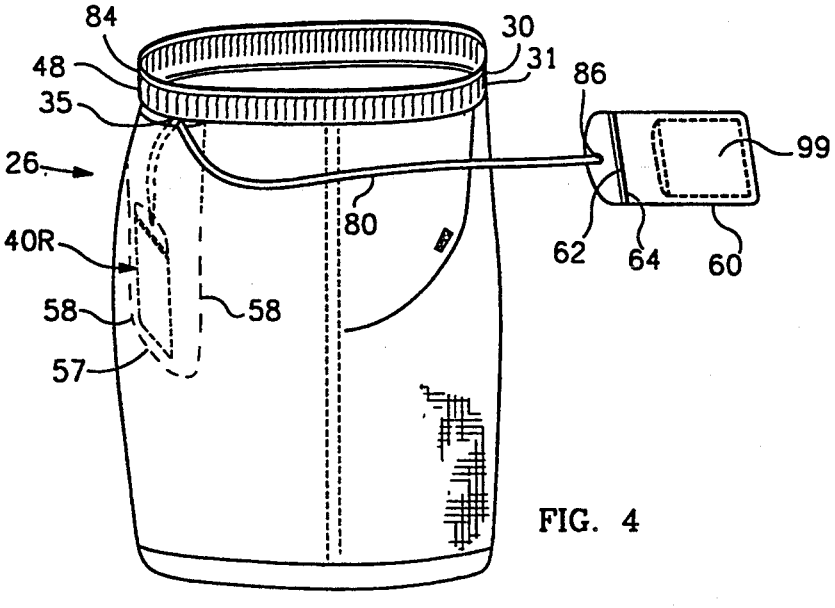
FIG. 4 is a side perspective view of an alternate embodiment of the invention showing a swimsuit and showing a waterproof pouch tethered to a suit rear pocket and showing, in phantom, the tethered waterproof pouch and tether in the suit rear pocket.

FIG. 4 is a side perspective view of an alternate embodiment of the invention showing swimsuit 20 having a rear slit 35R therethrough and a rear pocket 40R having an opening 48 arranged in registration with slit 35. Rear pocket 40R, shown, uses suit material 22 as its front wall 42. Pocket rear wall 44 is attached to suit 20 along the sides at seams 58 and along the bottom at seam 57 and along the top at waist 30. Bottom seam 57 need not be above the hem 59 but may be integral with hem seam 59. Tether 80 may be attached as described with reference to front pocket 40F.

The phantom lines show pouch 60 and rear tether 80R in the stored position in rear pocket 40R. The solid lines show pouch 60 removed from pocket 40R. Tether 80 is flexible and of sufficient length such that pouch 60 can be removed from pocket 40R and held to the front of a wearer for inserting therein items for safekeeping.

Having described the invention, it can be seen that it provides a very convenient device for keeping valuables on the person while engaging in water sports.

Although a particular embodiment of the invention has been illustrated and described, various changes may be made in the form, composition, construction, and arrangement of the parts without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. In combination:

a bathing suit having an inner side toward a wearer and an outer side; said suit having a slit therethrough and including a suit pocket disposed on the inner side of said suit and connected thereto; said suit pocket having a bottom and having a top; said top including an opening arranged in registration with said slit;

a waterproof pouch disposed in said suit pocket; said waterproof pouch being made of pliable waterproof material and having a sealable opening such that, when sealed, liquids may not enter said waterproof pouch; said waterproof pouch capable of passing through said slit and said top opening; and a tether having:

a first end attached to said suit; and a second end attached to said waterproof pouch; said tether being flexible and of sufficient length such that said waterproof pouch can be removed from said suit pocket for inserting therein items for safekeeping.

2. The combination of claim 1 wherein:

said bathing suit includes a waistband; and said tether first end is sewn into said waistband.

3. The combination of claim 1 wherein:

said tether first end is attached to said suit pocket.

4. The combination of claim 1 wherein:

said bathing suit includes a waistband;

said suit pocket includes a back wall extending to said waistband; and said tether first end is sewn into said waistband such that said tether can be entirely within said suit pocket and concealed within said suit pocket.

5. In combination:

a bathing suit having a front and a rear and an inner side toward a wearer and an outer side; said suit having a slit therethrough in the rear and including a suit pocket disposed on the inner side of said suit and connected thereto; said suit pocket having a bottom and having a top; said top including an opening arranged in registration with said slit;

a waterproof pouch disposed in said suit pocket; said waterproof pouch being made of pliable waterproof material and having a sealable opening such that, when sealed, liquids may not enter said waterproof pouch; said waterproof pouch capable of passing through said slit and said top opening; and a tether having:

a first end attached to said suit; and a second end attached to said waterproof pouch; said tether being flexible and of sufficient length such that said waterproof pouch can be removed from said pocket and held to the front of a wearer for inserting therein items for safekeeping.

6. The combination of claim 5 wherein:

said bathing suit includes a waistband; and said tether first end is sewn into said waistband.

7. The combination of claim 5 wherein:

said tether first end is attached to said suit pocket.

8. The combination of claim 5 wherein:

said bathing suit includes a waistband;

said suit pocket includes a back wall extending to said waistband; and said tether first end is sewn into said waistband such that said tether can be entirely within said suit pocket and concealed within said suit pocket.

* * * * *